US005604074A

United States Patent [19]

Yasuda et al.

[11] Patent Number: 5,604,074

[45] Date of Patent: Feb. 18, 1997

[54] METHOD OF DEVELOPMENT OF NONMAGNETIC ONE-COMPONENT TONER AND METHOD FOR FORMING FIXED IMAGES USING THE DEVELOPMENT

[75] Inventors: Shin-ichiro Yasuda, Osaka; Kuniyasu Kawabe; Koji Akiyama, both of Wakayama; Mitsuhiro Sasaki, Ichikawa; Koji Kameyama, Wakayama-ken, all of Japan

[73] Assignee: KAO Corporation, Tokyo, Japan

[21] Appl. No.: 432,931

[22] Filed: May 1, 1995

Related U.S. Application Data

[63] Continuation of Ser. No. 208,581, Mar. 11, 1994, abandoned.

[30] Foreign Application Priority Data

Mar. 15, 1993 [JP] Japan ..... 5-081434

[51] Int. Cl.[6] ..... G03G 13/06; G03G 9/093

[52] U.S. Cl. ..... 430/120; 430/102; 430/109; 430/111; 430/124; 430/138; 430/903

[58] Field of Search ..... 430/102, 138, 430/111, 109, 120, 903, 121

[56] References Cited

U.S. PATENT DOCUMENTS

| | | | |
|---|---|---|---|
| 2,221,766 | 11/1940 | Carlson . | |
| 2,297,691 | 10/1942 | Carlson . | |
| 2,357,809 | 9/1944 | Carlson . | |
| 4,675,266 | 6/1987 | Fujiwara et al. | 430/102 |
| 5,035,970 | 7/1991 | Hsieh et al. | 430/109 |
| 5,155,532 | 10/1992 | Sakurada et al. | 430/120 |
| 5,266,436 | 11/1993 | Aoto et al. | 430/120 |
| 5,389,487 | 2/1995 | Kawakami et al. | 430/120 |
| 5,428,435 | 6/1995 | Yasuda et al. | 430/109 |

FOREIGN PATENT DOCUMENTS

| | | | |
|---|---|---|---|
| 0453857 | 10/1991 | European Pat. Off. . | |
| 454980 | 11/1991 | European Pat. Off. | 430/109 |
| 0501673 | 9/1992 | European Pat. Off. . | |
| 536661 | 4/1993 | European Pat. Off. | 430/109 |

OTHER PUBLICATIONS

English abstract of JP 61056352 (Pub Mar. 22, 1986).
English abstract of JP 63128357 (Pub May 31, 1988).
English abstract of JP 63128358 (Pub May 31, 1988).
English abstract of JP 1267660 (Pub Jan, 25, 1989).
English abstract of JP Pub. No. 02-051175 (Pub Feb. 21, 1990).
Patent Abstracts of Japan, vol. 8, No. 55 (P-260) 13 Mar. 1984 & JP-A-58 205 164 (abstract) patent pub. Nov. 30, 1983.
English abstract of EP 587036 (Pub Mar. 16, 1994).
English abstract of JP 58176642 (Pub Oct. 17, 1983).
English abstract of JP 58176643 (Pub Oct. 17, 1983).

*Primary Examiner*—Janis L. Dote
*Attorney, Agent, or Firm*—Birch, Stewart, Kolasch & Birch, LLP

[57] ABSTRACT

A developing method of the present invention has the steps of forming a uniform layer of a nonmagnetic one-component toner on a developer carrying sleeve with a developer blade; rotating an electrostatic latent image forming member and the developer carrying sleeve; and applying the toner on the developer carrying sleeve onto an electrostatic latent image formed on the electrostatic latent image forming member. The toner used herein is an encapsulated toner having a heat-fusible core material and a shell formed thereon. By using this development for a nonmagnetic one-component toner of the present invention, clear images free from background can be stably formed for a large number of copying.

9 Claims, 5 Drawing Sheets

METHOD OF DEVELOPMENT OF NONMAGNETIC ONE-COMPONENT TONER AND METHOD FOR FORMING FIXED IMAGES USING THE DEVELOPMENT

This application is a continuation of application Ser. No. 08/208,581, filed on Mar. 11, 1994, the entire contents of which are hereby incorporated by reference, now abandoned.

BACKGROUND OF THE INVENTION

Field of the Invention

The present invention relates to a method for development of a nonmagnetic one-component toner and to a method of forming fixed images using the development which are applicable to plain paper copying machines, laser printers, plain paper facsimiles, etc. More particularly, it relates to a method for an electrostatic image development and to a method for forming fixed images suitable for a reprography system utilizing a nonmagnetic one-component development in the case where an encapsulated toner whose shell comprises an amorphous polyester as the main component is used as the toner therefor.

Discussion of the Related Art

Conventionally, when images are formed with copying machines, laser beam printers, etc., the Carlson Method has been generally used (U.S. Pat. No. 2,221,776, 2,297,691 and 2,357,809, "Electrophotography," p22–p41, R. M. Shaffert, 1965, The Focal Press).

In the electrophotographic method, after the electrostatic latent image formed on a photoconductor by optical means is developed in a developing process, it is transferred to a recording medium such as a recording paper in a transfer process and then fixed into the final image generally with large amounts of heat and pressure using a fixing roller in a fixing process. In the conventional method for forming fixed images as described above, however, through the processes from the formation of the electrostatic latent image up to the fixing thereof onto the recording medium, the temperature of the heating element of the fixing device has to remain at a very high level and further a high pressure is required.

On the other hand, since both the photoconductor and the developer device have to be maintained at around room temperature, a considerable distance has to be maintained between the fixing portion and the photoconductor or the developer device, which necessitates in making the machine larger. In addition, it is necessary to force the removal of the generated heat from the system. The noise produced by the forced radiation device and the heat dissipated thereby are one of the major factors of environmental disruption in business offices.

Since the fixing process works independently and fixing is usually carried out with a fixing device at such a high temperature of around 200° C. with a nip pressure of not less than 2 kg/cm, as mentioned above, expensive heat-resistant materials such as heat-resistant resins, heat-resistant rubbers, etc. have to be provided in the periphery of the fixing device. Since the fixing is carried out at a high temperature as described above, such problems as curling and jamming of the paper, etc. are likely to take place. In addition, a fixing failure may take place due to heat absorption by the paper, depending upon its thickness.

In addition, when the fixing requires a high temperature, it takes more time to reach the set temperature so that the waiting time for printing cannot be shortened. In such a case, therefore, this method is unsuitable for devices such as a facsimile which requires quick printings. On the other hand, when fixing is carried out at a temperature of not more than 100° C. using the conventional toners, the softening by heat of the resins contained in the toners cannot be expected, so that fixing mainly takes place by the plastic deformation of the resins. Therefore, a large nip pressure of normally not less than 5 kg/cm is necessary, thereby not only making it necessary to use a large-scale fixing device, but also making the fixing strength of the obtained fixed image poor when compared with that of heat-fixing device, and causing such problems as wrinkling of a paper used as a recording medium.

In view of the above, a novel system for development and a matching toner therefor are in demand. In order to meet this demand, the present inventors have developed an encapsulated toner whose shell comprises an amorphous polyester as the main component, and filed a patent application therefor (Japanese Patent Application No. 4-259088). This encapsulated toner is fixable with a low nip pressure at an extremely low temperature, excellent in offset resistance and blocking resistance when the encapsulated toner is used for heat-and-pressure fixing, thereby making it possible to stably form clear visible images free from background for a large number of copying. Further, in order to achieve a long service life of the developer, it has been necessary to effectively charge the developer at a low stress.

SUMMARY OF THE INVENTION

An object of the present invention is to provide a method for development of a nonmagnetic one-component toner for developing latent images on an electrostatic latent image forming member, particularly suitable for an encapsulated toner whose shell comprises an amorphous polyester as the main component.

Another object of the present invention is to provide a method for forming fixed images utilizing such a development.

The gist of the present invention is as follows:

(1) A developing method using a developer device comprising a developer carrying sleeve arranged in contact with or near an electrostatic latent image forming member and a developer blade arranged opposite to the developer carrying sleeve by which a layer of toners on the developer carrying sleeve is regulated, the method comprising the steps of forming a uniform layer of a nonmagnetic one-component toner on the developer carrying sleeve with the developer blade; rotating the electrostatic latent image forming member and the developer carrying sleeve; and applying the toner on the developer carrying sleeve onto an electrostatic latent image formed on the electrostatic latent image forming member to visualize the electrostatic latent image, wherein the toner is an encapsulated toner comprising a heat-fusible core material containing at least a thermoplastic resin and a coloring agent and a shell formed thereon so as to cover the surface of the core material, the glass transition temperature ascribed to the thermoplastic resin used as the main component of the core material being 10° C. to 50° C., and wherein said toner has the following properties of the compressive variation:

(a) The minimum load required for 5% compression of the particle size is 5 to 80 mgf; (milligram force) and (b) The minimum load required for 10% compression of the particle size is 10 to 160 mgf, provided that the compressive variation to one toner particle is measured by using a micro compression testing machine comprising a flat upper pressurizing element made of diamond having a diameter of 50 μm and a flat lower pressurizing element made of SKS (Special Steel) according to JIS Standard at a temperature of 25° C. and a humidity of 50%, and the load is applied at a speed of 9.1 mgf/sec; and (2) A method for forming fixed images comprising the steps of forming an electrostatic latent image on an electrostatic latent image forming member, applying a toner to the electrostatic latent image, thereby developing the electrostatic latent image to form a visible image, and transferring and fixing the formed visible image to a recording medium, wherein the developing process is carried out by the method of (1) described above.

By using the development for a nonmagnetic one-component toner of the present invention, which is particularly suitable in the case where the encapsulated toner whose shell comprises an amorphous polyester as the main component, clear images free from background can be stably formed for a large number of copying. Therefore, by using the method for forming fixed images utilizing this development, a high image quality can be maintained, and the developer device can be miniaturized. Further various merits due to the low-temperature fixing ability of the encapsulated toner are obtained.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

Figure 1:
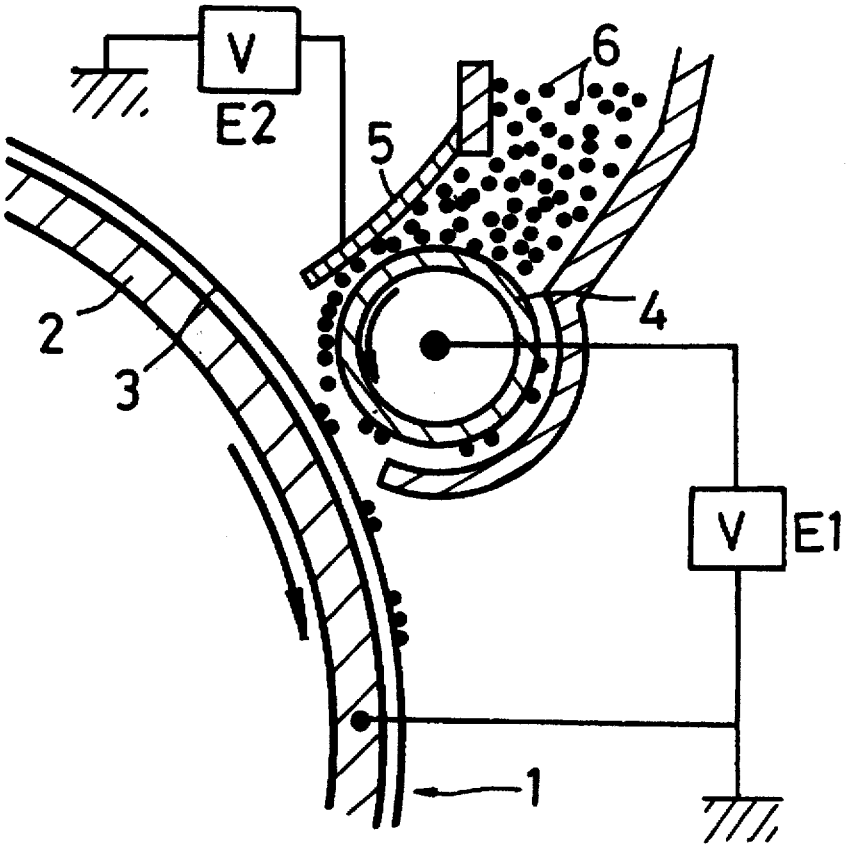
FIG. 1 is a schematic view showing one example of a typical developer device which can be used in the present invention.

The reference numerals in FIGS. 1 through 5 denote the following elements:

Element 1 is a photoconductor, element 2 a conductive supporter, element 3 a photoconductive layer, element 4 a developer carrying sleeve, element 5 a developing blade, element 6 a toner, element 7 a conductive fibrous brush, element 8 an exposure device, element 9 a developer device, element 10 a heat roller, element 11 a pressure roller, element 12 a transfer device, element 13 a recording medium (a recording paper), element 14 a charger, element 15 a cleaner device, element 16 a toner collecting box, and element 17 a charge eraser.

DETAILED DESCRIPTION OF THE INVENTION

The method for development of the present invention using the encapsulated toners comprises the steps of forming a uniform layer of a nonmagnetic one-component toner on the developer carrying sleeve with the developer blade; rotating the electrostatic latent image forming member and the developer carrying sleeve; and applying the toner on the developer carrying sleeve onto the electrostatic latent image formed on the electrostatic latent image forming member to visualize the electrostatic latent image. The above development can be used for developing a latent image formed on a photoconductor as a latent image forming member, and also for developing a latent image formed on a dielectric material.

Figure 2:
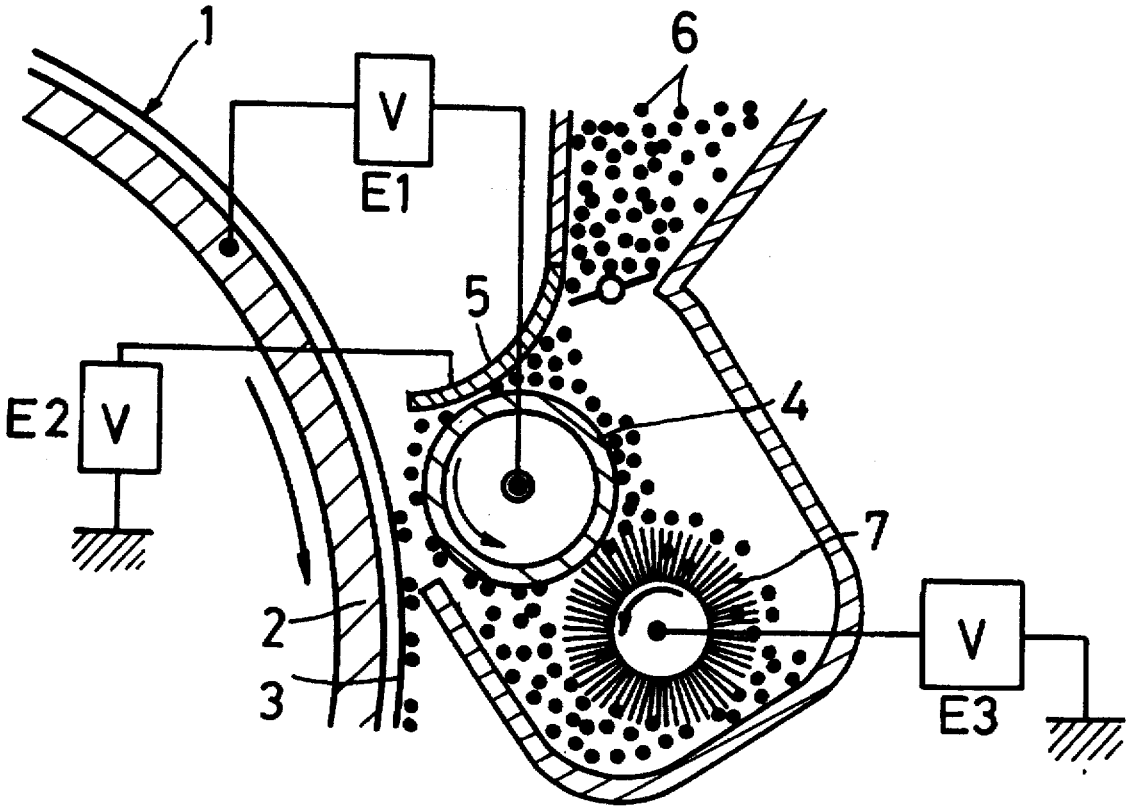
FIG. 2 is a schematic view showing another example of a typical developer device which can be used in the present invention.
Figure 3:
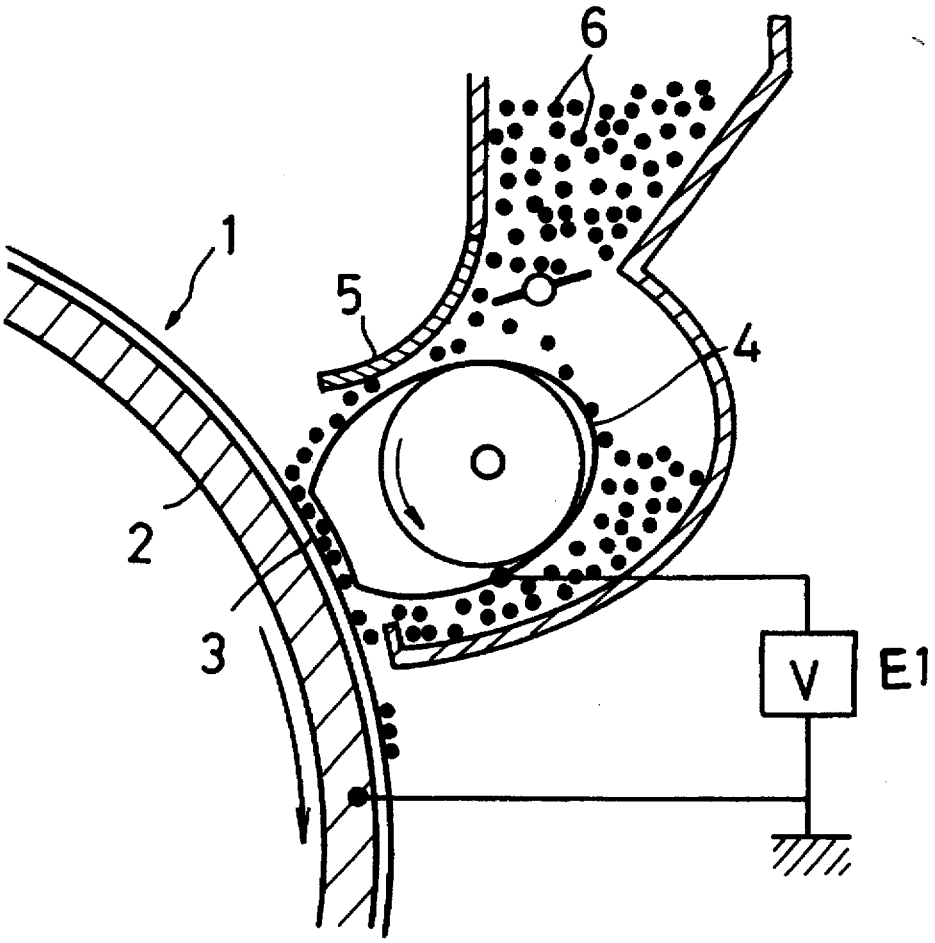
FIG. 3 is a schematic view showing a still another example of a typical developer device which can be used in the present invention.

FIGS. 1 to 3 are schematic views showing examples of typical developer devices using for the development of nonmagnetic one-component toner in the present invention.

1 is a photoconductor which comprises a conductive supporter 2 and a photoconductive layer 3, and any of the known organic photoconductors (OPC) and inorganic photoconductors can be used. When a dielectric member is used, films made of fluororesins, polyimide resins, polyester resins and polypropylene, or conductive layers coated with a dielectric member may be used.

4 is a developer carrying sleeve, which is a carrier for a toner. Examples of the developer carrying sleeve include a cylinder made of conductive nonmagnetic metals such as stainless steels and aluminum; and a cylinder made of conductive resins prepared by dispersing conductive fine particles such as graphite and conductive carbons in such resins as melamine resins, acrylic resins and phenol resins, so as to adjust its specific resistivity to $10^{-2}$ to $10^{-8}$ Ω.cm. The photoconductor and the developer carrying sleeve rotate at a constant peripheral speed by an optional driving means not illustrated in the figure.

5 is a developing blade which is provided for regulating the thickness of the layer of toners to form a uniform layer of the toner and to adjust the chargeability. The developing blade 5 is arranged opposite to the developer carrying sleeve 4. Plates having a thickness of 0.1 to 2.0 mm made of stainless steel, copper, aluminum, etc. are generally used therefor. Also, dielectric or semiconductive materials which are suitable for charging the toner to a desired polarity can be used. A high tribo electric charge efficiency can be attained by using, for instance, ethylene-propylene rubbers, fluororesin rubbers, polychlorobutadiene, and polyisoprene for positively charging the toner; or by using, for instance, silicone rubbers, polyurethane rubbers, and styrene butadiene rubbers for negatively charging the toner. The nip pressure of the developing blade 5 onto the developer carrying sleeve 4 is usually 0.1 to 3.0 gf/mm (gram-force per millimeter), preferably 0.3 to 2.5 gf/mm, more preferably 0.5 to 2.0 gf/mm, from the viewpoints of effectively providing a thin layer formation and uniform chargeability. When the nip pressure is less than 0.1 gf/mm, a sufficient thin layer formation is not likely to be achieved, thereby causing background, and when it exceeds 3.0 gf/mm, the stress onto the toner undesirably increases, thereby making it likely to cause the melting of the toner onto the developer carrying sleeve.

A gap between the photoconductor 1 and the developer carrying sleeve 4 is not less than the thickness of the toner layer, so as to prevent background during development. Also, the photoconductor 1 and the developer carrying sleeve 4 rotate in the same direction at the gap portion mentioned above. In order to improve the developing efficiency, as shown in FIGS. 1 and 2, it is preferable to apply a direct current voltage with a power source E1 of ±50 V to ±2000 V, preferably ±100 V to ±1000 V, between the developer carrying sleeve 4 and the photoconductor 1. Further, if necessary, in order to improve the chargeability of the toner, to reduce background and to improve the resolution of the printed images, an alternating voltage such as an alternating current voltage may be superimposed thereto at 100 V 2000 V (peak to peak; hereinafter simply referred to as "P—P") at a frequency of normally 100 Hz to 10 kHz, preferably 100 Hz to 3000 Hz.

By providing conductivity to the developing blade 5, excessive charging of the toner can be prevented, thereby making it possible to prevent electrostatic agglomeration or solidification of the toners. Also, in order to improve the developing efficiency and to obtain stable chargeability, it is also possible to apply a given voltage to the developing blade 5 in the range from ±100 V to ±800 V with a power source E2 as shown in FIGS. 1 and 2.

As shown in FIGS. 1 and 2, the developer carrying sleeve can be arranged with a gap near the photoconductor. Alternatively, as shown in FIG. 3, a flexible belt-type developer carrying sleeve which is arranged in contact with a photoconductor can be used. In this case, a highly accurate gap between the developer carrying sleeve and the photoconductor would not be necessitated, and the pressure exerted onto the toner is somewhat relieved. Therefore, the service life of the developer can be made long, so that it can be presented as a preferred example of a contact development among the developer devices used in the present invention. The materials for the flexible belt-type developing carrying sleeve are not particularly limitative, and examples thereof include conductive inorganic materials and conductive plastic films. The flexible belt-type developer carrying sleeve provided with an elastic rubber roller in the inner portion can be similarly used for the same purposes.

The device schematically shown in FIG. 3 is described below. As in the same manner as the developer device of FIG. 1, in order to improve the developing efficiency, it is preferable to apply a direct current voltage with a power source E1 of ±50 V to ±2000 V, preferably ±100 V to ±1000 V, between the developer carrying sleeve 4 and the photoconductor 1.

Further, if necessary, in order to improve the chargeability of the toner, to reduce background of the printed images and to improve the resolution of the printed images, an alternating voltage such as alternating current voltage may be superimposed thereto at 100 V to 2000 V (P—P) at a frequency of normally 100 Hz to 10 kHz, preferably 100 Hz to 3000 Hz.

Even in these cases, if necessary, in order to improve the developing efficiency and to obtain stable chargeability, it is also possible to apply a given voltage to the developing blade in the range from ±100 V to ±800 V in the same manner as the developer devices as shown in FIGS. 1 and 2.

In the present invention, in order to make the electric charges of the toner uniform and stable, the toner can be stirred by a given member such as a stirring paddle (not shown in the figure). The shape of the stirring paddle is not particularly limitative, as long as the stirring paddle can be effectively used for stirring and circulation of the toner in the developing vessel. FIG. 2 schematically shows a device using a conductive fibrous brush 7 for charging the toner. Examples of the conductive fibrous brushes include those produced by using conductive resin fibers, in which nylon resins, rayon resins, etc. are dispersed with conductive carbons, or in which the surface thereof is coated with conductive carbons, conductive paints, etc.; and forming the obtained conductive resin fibers into a brush-like structure on a metal shaft or a conductive resin cylinder rotatably supported on the inner wall of the developing vessel. The conductive fibrous brush supplies the toner onto the developer carrying sleeve by rotating itself while partially contacting the developer carrying sleeve 4 at a constant peripheral speed in a direction shown by the arrow in the figure.

In order to improve the charging efficiency, it is also possible to apply a direct current voltage to the brush in the range from ±100 V to ±800 V with a power source E3. Further, in order to attain the stable chargeability of the toner and to prevent the agglomeration of the toner on the brush, an alternating voltage may be superimposed thereto at 300 V to 3000 V (P—P) at a frequency of normally 200 Hz to 10 kHz, preferably 200 Hz to 3000 Hz.

The method for forming fixed images of the present invention comprises the steps of forming an electrostatic latent image on an electrostatic latent image forming member, applying a toner to the electrostatic latent image, thereby developing the electrostatic latent image to form a visible image, and transferring and fixing the formed visible image to a recording medium, wherein the developing process is carried out by the method for development described above using the nonmagnetic one-component toner.

Figure 4:
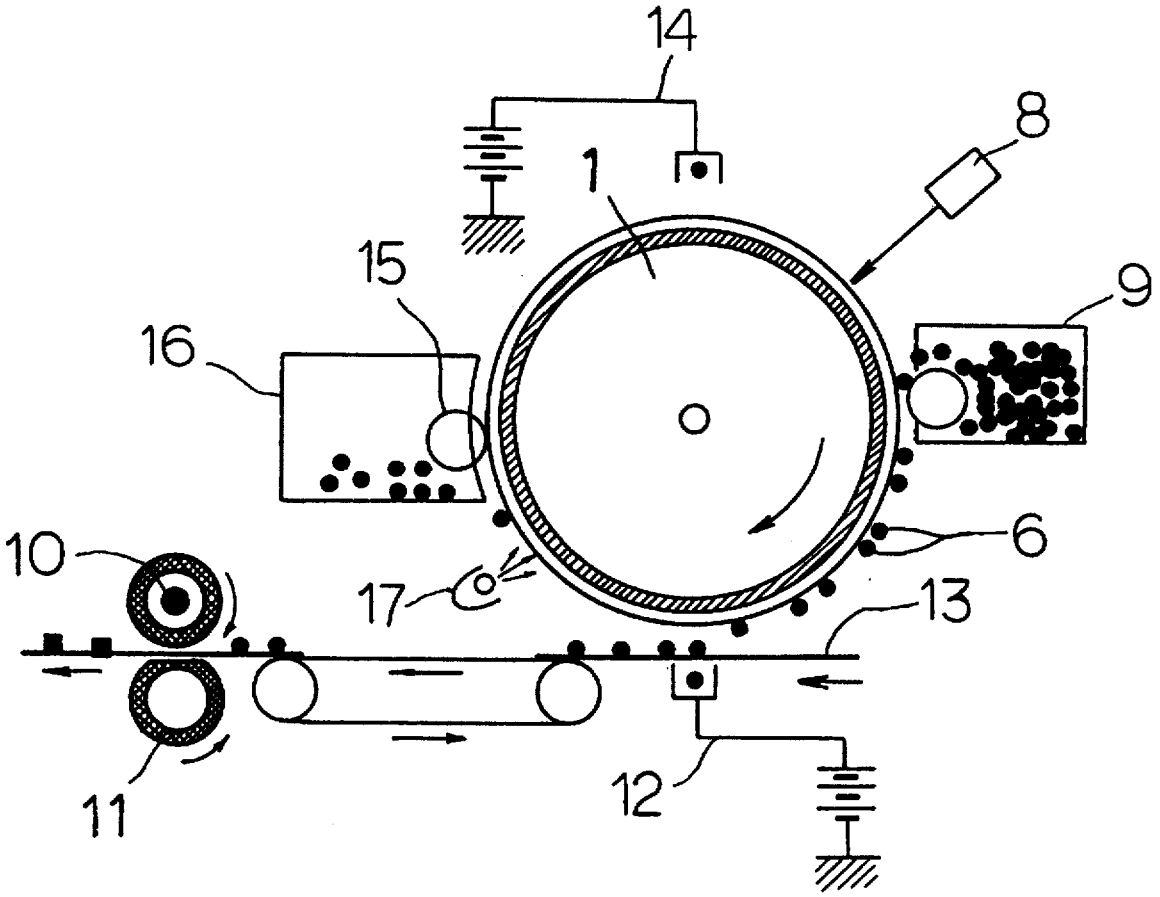
FIG. 4 is a schematic view showing one example of a typical apparatus for forming fixed images which can be used in the present invention.

FIG. 4 shows a schematic view of a typical apparatus which can be used for the method for forming 10 fixed images of the present invention. In this apparatus, after the electrostatic latent image formed on a photoconductor by optical means is developed in a developing process, it is transferred to a recording medium such as a recording paper in a transfer process and then fixed into the final image generally with heat and pressure in a fixing process. As the photoconductor is repeatedly used, a cleaning device is provided for cleaning the residual toner after the transfer process with its rotation.

The method for forming fixed images of the present invention is not particularly limitative to the use of the apparatus described above, and any of the ordinary known apparatuses can be used.

The encapsulated toner used in the present invention comprises a heat-fusible core material containing at least a thermoplastic resin and a coloring agent and a shell formed thereon so as to cover the surface of the core material. The glass transition temperature ascribed to the thermoplastic resin used as the main component of the core material is 10° C. to 50° C., preferably 15° C. to 45° C. When the glass transition temperature (Tg) is less than 10° C., the storage stability of the resulting encapsulated toner is undesirably poor, and when it exceeds 50° C., the fixing strength of the encapsulated toner is undesirably poor.

Also, in the encapsulated toner used in the present invention, when a load is applied to one toner particle, the minimum load required for 5% compression of the particle size is 5 to 80 mgf, and the minimum load required for 10% compression is 10 to 160 mgf. This property can be determined by using a micro compression testing machine under the following conditions:

(1) Micro compression testing machine: Equipped with a flat upper pressurizing element made of diamond having a diameter of 50 μm and a flat lower pressurizing element made of SKS.

(2) Temperature: 25° C., humidity: 50%.

(3) The load is applied at a speed of 9.1 mgf/sec.

More particularly, the encapsulated toner having the following relationships between the load and the compressive variation of the toner particles are suitably used in the present invention. Specifically, the compressive variation can be measured by using, for instance, a micro compression testing machine MCTM-200 (manufactured by Shimadzu Corporation, Kyoto, Japan) when the load is applied to one toner particle at a temperature of 25° C. and a humidity of 50%. This testing machine comprises an upper pressurizing element and a lower pressurizing element, wherein the upper pressurizing element is a flat element made of diamond having a diameter of 50 μm, and the lower pressurizing element is a flat plate made of SKS. The load is applied at a speed of 9.1 mgf/sec. The measurement is taken for each toner particle, and then repeated for not less than ten times. The value given herein is an average value for ten measurements. This average value of the compressive variation thus calculated is highly reproducible. Here, the particle size is determined by measuring with a device (an optical microscope) attached to the testing machine and averaging the lengths taken in the longitudinal and lateral directions.

Figure 5:
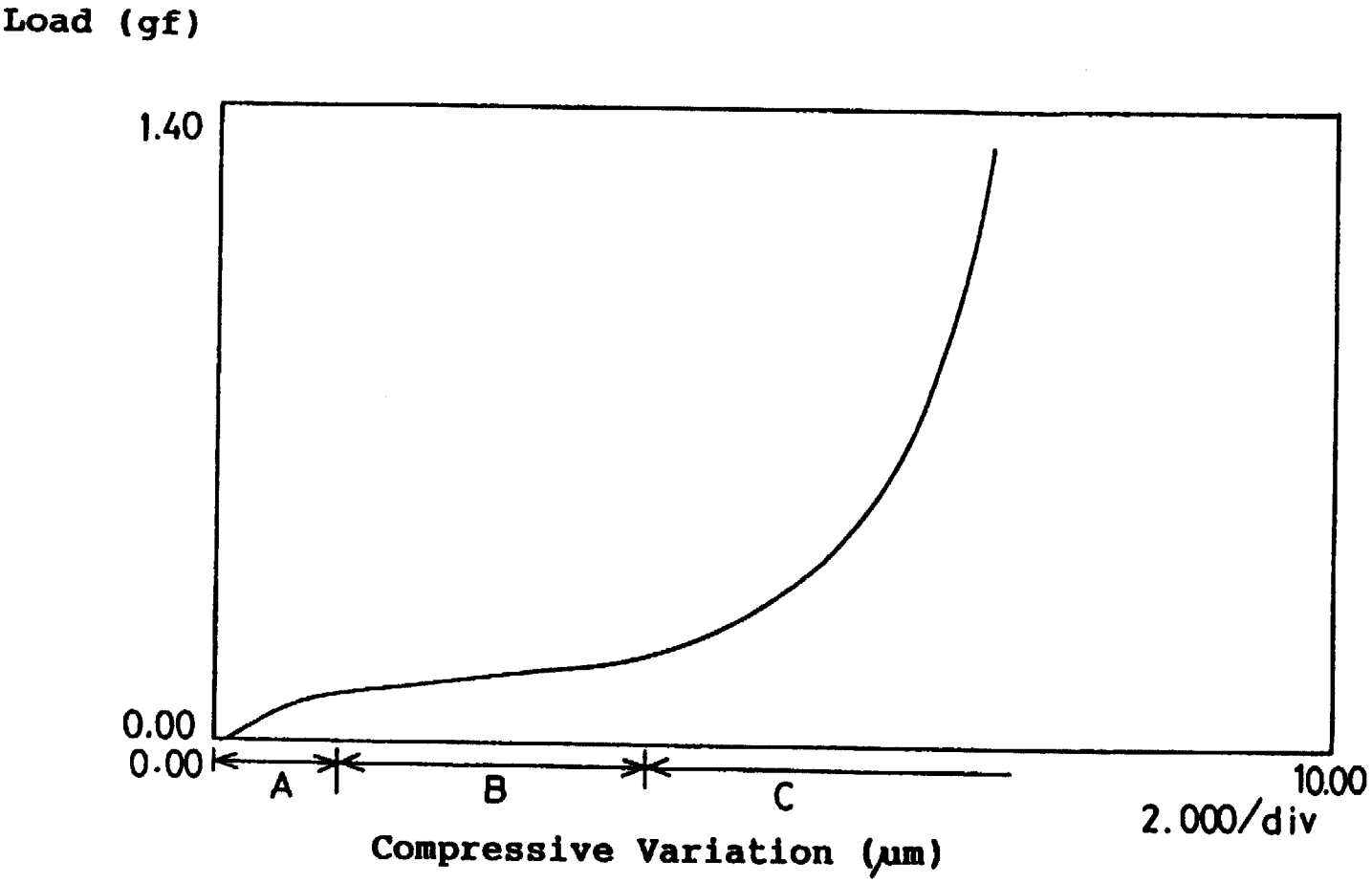
FIG. 5 is a graph showing the relationship between the load and the compressive variation measured by the micro compression testing machine.

FIG. 5 is a graph showing a typical relationship between the load applied and the compressive variation obtained under the conditions described above. In the range "A" of the figure, a so-called kickoff portion, the compressive variation increases linearly with the load, and in the range "B," an inflection point appears where the compressive variation changes drastically at a given value of load. This means that the toner particle can no longer resist the load applied thereonto, so that a drastic deformation takes place. In the range "C," another inflection point appears, from which the compressive variation becomes very small even when a large load is applied, meaning that the toner particle is completely smashed by the load. Therefore, in order to improve the low-temperature fixing ability of the toner, a toner capable of being deformed and smashed even with a smaller load is highly desired. On the other hand, in order to endure stress caused by stirring in the developer device, particularly to endure the stress caused by the nip pressure between the developer carrying sleeve and the developing blade for regulating the thickness of the layer of toners on the developer carrying sleeve in the nonmagnetic one-component development, it is necessary to make the toner unsmashable even with a larger load.

As described above, since the hardness of the toner is well-reflected in the relationship between the load and the compressive variation in the range "A," a further detailed investigation is made with respect to the load and the compressive variation in the range "A,", the low-temperature fixing ability, and the stress resistance in the developer device. As a result, it was found that properties suitable for toners could be obtained when the minimum load required for 5% compression of the particle size was in the range from 5 to 80 mgf, preferably from 7.5 to 75 mgf, more preferably from 10 to 70 mgf, and when the minimum load required for 10% compression was in the range from 10 to 160 mgf, preferably from 15 to 150 mgf, more preferably from 20 to 140 mgf.

When the minimum load required for 5% compression of the particle size is less than 5 mgf or the minimum load required for 10% compression is less than 10 mgf, the adhesion of the toner particles and the melting of the toner onto the developer carrying sleeve are likely to take place due to the stress caused in the developer device, and thereby black spots and background appear on the recording medium. When the minimum load required for 5% compression of the particle size exceeds 80 mgf or the minimum load required for 10% compression exceeds 160 mgf, the fixing ability tends to be poor.

The encapsulated toner in the present invention has the glass transition temperature described above, and also has properties meeting such a relationship between the compression and the load as described above. The encapsulated toner in the present invention meets requirements in, for instance, low-temperature fixing ability, stress resistance in the developer device and blocking resistance. The encapsulated toner in the present invention is not particularly limitative, as long as it has the above properties. For example, those prepared by the method disclosed in Japanese Patent Laid-Open Nos. 58-176642, 58-176643, 61-56352, 63-128357; 63-128358, 01-267660, and 02-51175 can be used. The encapsulated toners mentioned above can be easily prepared by the following methods.

(1) A spray-drying method, wherein after the core material is dispersed in a non-aqueous solution of polymer or polymer-emulsion, the dispersed liquid is spray-dried.

(2) A phase separation method (coacervation method), wherein phase separation is conducted around the core material in a solution of ionic polymer colloids and the core material, so that a simple emulsion is first prepared, which in turn is converted to a complex emulsion, in which the core materials are micro-encapsulated.

(3) An interfacial polymerization method, wherein a core material solution or dispersion is dispersed in a water in oil or oil in water type emulsion system, while at the same time collecting the shell material monomers (A) around the surfaces, which in turn is followed by reacting monomers (A) with monomers (B) around the surfaces in the subsequent step.

(4) Other methods include an in situ polymerization method, a submerged cure coating method, an air suspension coating method, an electrostatic coalescing method, a vacuum vapor deposition coating method, etc.

In the present invention, although various kinds of encapsulated toners prepared by the methods mentioned above can be used, as a preferred embodiment, an encapsulated toner comprising a heat-fusible core material containing at least a thermoplastic resin and a coloring agent and a shell formed thereon so as to cover the surface of the core material, wherein the main component of the shell comprises an amorphous polyester, can be suitably used. Since this encapsulated toner is excellent in offset resistance and blocking resistance and fixable at a low temperature, when the encapsulated toner is used for heat-and-pressure fixing, thereby making it possible to stably form clear visible images free from background for a large number of copying. Therefore, this encapsulated toner is highly suitable for the method for development of the present invention.

The amorphous polyester used in the present invention is a toner whose shell comprises an amorphous polyester as the main component. The amorphous polyester can generally be obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. Among them, the amorphous polyesters obtained by the condensation polymerization of monomers containing a dihydric alcohol monomer and a dicarboxylic acid monomer, and further at least a trihydric or higher polyhydric alcohol monomer and/or a tricarboxylic or higher polycarboxylic acid monomer are suitably used (Japanese Patent Application No. 4-259088). The amorphous polyester described above can be contained in an amount of normally 50 to 100% by weight, based on the total weight of the shell, and the other components which may be contained in the shell include polyamides, polyester-amides, and polyurea resins which are contained in an amount of 0 to 50% by weight.

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adduct of bisphenol A, ethylene adduct of bisphenol A, hydrogenated bisphenol A and other dihydric alcohols.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols. Among them, the trihydric alcohols are preferably used.

In the present invention, these dihydric alcohol monomers and trihydric or higher polyhydric alcohol monomers may be used singly or in combination.

As for the acid components, examples of the dicarboxylic acid components include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and acid anhydrides thereof, lower alkyl esters thereof and other dicarboxylic acid components.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, and acid anhydrides thereof, lower alkyl esters thereof and other tricarboxylic or higher polycarboxylic acid components. In the present invention, among these carboxylic acid components, a preference is given to the tricarboxylic acids or the derivatives thereof.

In the present invention, these dicarboxylic acid monomers and tricarboxylic or higher polycarboxylic acid monomers may be used singly or in combination.

The method for producing an amorphous polyester in the present invention is not particularly limitative, and the amorphous polyester can be produced by esterification or transesterification of the above monomers.

Here, "amorphous" refers to those which do not have a definite melting point. When a crystalline polyester is used in the present invention, the amount of energy required for fusion is large, thereby making the fixing ability of the toner undesirably poor.

The glass transition temperature of the amorphous polyester thus obtained is preferably 50° to 80° C., more preferably 55° to 75° C. When the glass transition temperature is less than 50° C., the storage stability of the toner becomes poor, and when it exceeds 80° C., the fixing ability of the resulting toner becomes undesirably poor. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC Model 200," manufactured by Seiko Instruments, Inc.), at a temperature rise rate of 10° C./min.

In the present invention, the acid value is preferably 3 to 50 KOH mg/g, more preferably 10 to 30 KOH mg/g. When it is less than 3 KOH mg/g, the amorphous polyester used as the shell-forming material is less likely to be formed on the core material during the in situ polymerization, thereby making the storage stability of the resulting toner poor, and when it exceeds 50 KOH mg/g, the polyester is likely to shift to a water phase, thereby making the production stability poor. Here, the acid value is measured according to JIS K0070.

The encapsulated toner whose shell is made of an amorphous polyester suitably used in the present invention can be produced by any known methods such as in situ polymerization. This encapsulated toner comprises a heat-fusible core material containing at least a thermoplastic resin and a coloring agent, and a shell formed thereon so as to cover the surface of the core material.

The resins to be used as the main component of the heat-fusible core materials of the encapsulated toner in the present invention are thermoplastic resins including polyester resins, polyester-polyamide resins, polyamide resins and polyvinyl resins, among which polyvinyl resins are particularly preferable. The glass transition temperatures (Tg) ascribed to the thermoplastic resin, which are the main component of the heat-fusible core material described above are preferably 10° to 50° C. When the glass transition temperature (Tg) is less than 10° C., the storage stability of the resulting encapsulated toner is undesirably poor, and when it exceeds 50° C., the fixing strength of the encapsulated toner is undesirably poor.

Among the above-mentioned thermoplastic resins, examples of the monomers constituting the vinyl resins include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; substituted monomers of ethylenic monocarboxylic acids such as acrylonitrile, methacrylonitrile and acrylamide; ethylenic dicarboxylic acids and substituted monomers thereof such as dimethyl maleate;

vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin-constituting components in the present invention, it is preferred that styrene or styrene derivatives is used in an amount of 50 to 90% by weight to form the main structure of the resins, and that the ethylenic monocarboxylic acid or esters thereof is used in an amount of 10 to 50% by weight to adjust the thermal properties such as the softening point of the resins, since the glass transition temperature of the core material resin can be controlled easily.

When the monomer composition constituting the core material-forming resin according to the present invention contains a crosslinking agent, which may be also used, if necessary, as a mixture of two or more of them, any known crosslinking agents may be appropriately used. Examples of crosslinking agents added include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably 0.001 to 15% by weight, more preferably 0.1 to 10% by weight, based on the vinyl polymerizable monomers. When the amount of these crosslinking agents used is more than 15% by weight, the resulting toner is unlikely to be melted with heat, thereby resulting in poor heat fixing ability and poor heat-and-pressure fixing ability. On the contrary, when the amount used is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place.

A graft or crosslinked polymer prepared by polymerizing the above monomers in the presence of an unsaturated polyester may be also used as the resin for the core material.

Examples of the polymerization initiators to be used in the production of the thermoplastic resins for the core materials include azo and diazo polymerization initiators such as 2,2'-azobis(2,4-dimethylvaleronitrile), 2,2'-azobisisobutyronitrile, 1,1'-azobis(cyclohexane-1-carbonitrile) and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the monomers to be polymerized.

In the present invention, a coloring agent is contained in the core material of the encapsulated toner, and any of the conventional dyes or pigments, which have been used for coloring agents for the toners may be used.

Examples of the coloring agents used in the present invention include various carbon blacks which may be 10 produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, and Solvent Blue 35, and the mixtures thereof. The coloring agent is usually used in an amount of about 1 to 15 parts by weight based on 100 parts by weight of the resin contained in the core material.

In the present invention, the charge control agent may be further added to the core material. Negative charge control agents to be added are not particularly limitative, and examples thereof include azo dyes containing metals such as "Varifast Black 3804" (manufactured by Orient Chemical), "Bontron S-31" (manufactured by Orient Chemical), "Bontron S-32" (manufactured by Orient Chemical), "Bontron S-34" (manufactured by Orient Chemical), "T-77" (manufactured by Hodogaya Kagaku) and "Aizenspilon Black TRH" (manufactured by Hodogaya Kagaku); copper phthalocyanine dye; metal complexes of alkyl derivatives of salicylic acid such as "Bontron E-81" (manufactured by Orient Chemical), "Bontron E-82" (manufactured by Orient Chemical), and "Bontron E-85" (manufactured by Orient Chemical); and quaternary ammonium salts such as "Copy Charge NX VP434" (manufactured by Hoechst); nitroimidazole derivatives, with a preference given to T-77 and Aizenspilon Black TRH.

The positive charge control agents are not particularly limitative, and examples thereof include nigrosine dyes such as "Nigrosine Base EX" (manufactured by Orient Chemical), "Oil Black BS" (manufactured by Orient Chemical), "Oil Black SO" (manufactured by Orient Chemical), "Bontron N-01" (manufactured by Orient Chemical), "Bontron N-07" (manufactured by Orient Chemical), and "Bontron N-11" (manufactured by Orient Chemical); triphenylmethane dyes containing tertiary amines as side chains; quaternary ammonium salt compounds such as "Bontron P-51" (manufactured by Orient Chemical), cetyltrimethylammonium bromide, and "Copy Charge PX VP435" (manufactured by Hoechst); polyamine resins such as "Bontron P-52" (manufactured by Orient Chemical); and imidazole derivatives, with a preference given to Bontron N-07.

The above charge control agents may be contained in the core material in an amount of 0.1 to 8.0% by weight, preferably 0.2 to 5.0% by weight.

If necessary, the core material may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons and silicone oils.

Examples of the above polyolefins include resins such as polypropylene, polyethylene, and polybutene, which have softening points of 80° to 160° C. Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate;

metal salts of ricinoleic acid with zinc and cadmium; and mixtures thereof. Examples of the above fatty acid esters include ethyl maleate, butyl maleate, methyl stearate, butyl stearate, cetyl palmitate, and ethylene glycol montanate. Examples of the above partially saponified fatty acid esters include montanic acid esters partially saponified with calcium. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid and selacholeic acid, and mixtures thereof. Examples of the above higher alcohols include dodecyl alcohol, lauryl alcohol, myristyl alcohol, palmityl alcohol, stearyl alcohol, arachyl alcohol, and behenyl alcohol. Examples of the above paraffin waxes include natural paraffins, microcrystalline waxes, synthetic paraffins, and chlorinated hydrocarbons. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, and sorbitan trioleate. Examples of the above silicone varnishes include methylsilicone varnish, and phenylsilicone varnish. Examples of the above aliphatic fluorocarbons include low polymerized compounds of tetrafluoroethylene and hexafluoropropylene, and fluorinated surfactants disclosed in Japanese Patent Laid-Open No. 53-124428. Among the above offset inhibitors, a preference is given to the polyolefins, with a particular preference to polypropylene.

It is preferable to use the offset inhibitors in a proportion of 1 to 20% by weight, based on the resin contained in the core material.

In the method for production of the encapsulated toner according to the present invention, the in situ polymerization as described above is preferably carried out from the viewpoint of simplicity in production facilities and production steps.

The method for production of the present invention is described hereinbelow by taking the in situ polymerization as one example thereof.

In the method for production of the encapsulated toner according to the present invention, the shell can be formed by utilizing such property that when a mixed solution comprising the core material-constituting material and the shell-forming material such as amorphous polyesters is dispersed in the aqueous dispersant, the shell-forming material localizes on the surface of the liquid droplets. Specifically, the separation of the core material-constituting material and the shell-forming material in the liquid droplets of the mixed solution takes place due to the difference in the solubility indices, and the polymerization proceeds in this state to form an encapsulated structure. By this method, since a shell is formed as a layer of shell-forming materials containing an amorphous polyester as the main component with a substantially uniform thickness, the tribo electric charge of the resulting toner becomes uniform.

More precisely, the encapsulated toner of the present invention can be produced by the following steps (a) to (c):

(a) dissolving a shell-forming material comprising an amorphous polyester as the main component in a mixture comprising a core material-constituting monomer and a coloring agent;

(b) dispersing the mixture obtained in the step (a) in an aqueous dispersant to give a polymerizable composition; and (c) polymerizing the polymerizable composition obtained in the step (b) by the in situ polymerization.

In the case of the shove method, a dispersion stabilizer is required to he contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate and sodium dodecylbenzenesulfonate. These dispersion stabilizers may be used alone or in combination of two or more.

Examples of the dispersion media for the dispersion stabilizer include water, methanol, ethanol, propanol, butanol, ethylene glycol, glycerol, acetonitrile, acetone, isopropyl ether, tetrahydrofuran, and dioxane, with a preference given to water. These dispersion media can be used singly or in combination.

In the method for the present invention, the amount of the shell-forming material comprising the above amorphous polyester as the main component is normally 3 to 50 parts by weight, preferably 5 to 40 parts by weight, more preferably 8 to 35 parts by weight, based on 100 parts by weight of the core material. When it is less than 3 parts by weight, the resulting shell becomes too thin in its thickness, thereby making the storage stability of the toner poor. When it exceeds 50 parts by weight, the droplets dispersed in the aqueous dispersant have an undesirably high viscosity, thereby making it difficult to produce fine grains, which in turn results in poor production stability.

In the present invention, an encapsulated toner for heat-and-pressure fixing which is prepared by further subjecting the encapsulated toner obtained as described above to a seed polymerization may be also be used. In other words, the encapsulated toner in the present invention include those produced by the in situ polymerization alone, and those produced by preparing an encapsulated toner by the in situ polymerization (hereinafter which may be simply referred to as "precursor particles"), and then carrying out the seed polymerization with the precursor particles.

Specifically, the seed polymerization is carried out by the steps of adding at least a vinyl polymerizable monomer and an initiator for vinyl polymerization to an aqueous suspension of the above precursor particles to absorb them into the precursor particles; and polymerizing the monomer components in the above precursor particles. For instance, after the precursor particles are produced by the in situ polymerization method described above, at least a vinyl polymerizable monomer and an initiator for vinyl polymerization are immediately added to the precursor particles in such a suspending state, and the monomer and the initiator are absorbed into the precursor particles, so that a seed polymerization takes place with the monomer components in the precursor particles. By this method, the production steps can be simplified. The vinyl polymerizable monomers, etc.

which are added to be absorbed into the precursor particles may be used in a state of an aqueous emulsion.

The aqueous emulsion to be added can be obtained by emulsifying and dispersing the vinyl polymerizable monomer and the initiator for vinyl polymerization in water together with a dispersion stabilizer, which may further contain a crosslinking agent, an offset inhibitor and a charge control agent, etc.

The vinyl polymerizable monomers used in the seed polymerization may be the same ones as those used for the production of the precursor particles described above. Also, the initiators for vinyl polymerization, the crosslinking agents and the dispersion stabilizers may also be the same ones as those used for the production of the precursor particles. The amount of the crosslinking agents used in the seed polymerization is preferably 0.001 to 15% by weight, more preferably 0.1 to 10% by weight, based on the vinyl polymerizable monomers. When the amount of these crosslinking agents used is more than 15% by weight, the resulting toner is unlikely to be melted with heat, thereby resulting in poor heat fixing ability and poor heat-and-pressure fixing ability. On the contrary, when the amount used is less than 0.001% by weight, in the heat-and-pressure fixing, a part of the toner cannot be completely fixed on a paper but rather adheres to the surface of a roller, which in turn is transferred to a subsequent paper, namely an offset phenomenon takes place.

In order to further improve the storage stability of the toner, the hydrophilic shell-forming material such as the amorphous polyester described above may be added to the aqueous emulsion. In this case, the amount of the hydrophilic shell-forming material added is normally 1 to 20 parts by weight, preferably 3 to 15 parts by weight, based on 100 parts by weight of the core material. Here, besides the amorphous polyester described above, examples of the hydrophilic shell-forming materials include vinyl resins having hydrophilic functional groups such as a carboxyl group, an acid anhydride group, a hydroxyl group, an amino group and an ammonium ion; an amorphous polyesteramide; an amorphous polyamide; and an epoxy resin. The aqueous emulsion described above can be prepared by uniformly dispersing the mixture using such devices as a ultrasonic vibrator.

The acid value of the amorphous polyester used in the seed polymerization, as in the case of that used in the production of the precursor particles described above, is preferably 3 to 50 KOH mg/g, more preferably 10 to 30 KOH mg/g. When it is less than 3 KOH mg/g, the amorphous polyester used as the shell-forming material is less likely to be formed on the core material during the seed polymerization, thereby making the storage stability of the resulting toner poor, and when it exceeds 50 KOH mg/g, the polyester is likely to shift to a water phase, thereby making the production stability poor. Here, the acid value is measured according to JIS K0070.

The amount of the aqueous emulsion added is adjusted so that the amount of the vinyl polymerizable monomer used is 10 to 200 parts by weight, based on 100 parts by weight of the precursor particles. When the vinyl polymerizable monomer is less than 10 parts by weight, sufficient effects for improving the fixing ability of the resulting toner cannot be achieved, and when it exceeds 200 parts by weight, it would be difficult to uniformly absorb the monomer components in the precursor particles.

By adding the aqueous emulsion thereto, the vinyl polymerizable monomer is absorbed into the precursor particles so that the swelling of the precursor particles takes place. The monomer components in the precursor particles are polymerized in the above state. This polymerization may be referred to as "seed polymerization," wherein the precursor particles are used as seed particles.

By further carrying out the seed polymerization by the method described above, the following features are remarkably improved in the resulting encapsulated toner when compared with the case where the encapsulated toner is produced by the in situ polymerization method alone.

Specifically, the encapsulated toner produced by the in situ polymerization method has more excellent low-temperature fixing ability and storage stability than conventional toners, and by further carrying out the seed polymerization method, a shell is formed more uniformly by the principle of surface science, thereby achieving a further excellent storage stability. Also, since the polymerizable monomer in the core material can be polymerized in two steps, namely, the in situ polymerization reaction and the seed polymerization reaction, the molecular weight of the thermoplastic resin in the core material can be easily controlled by using a suitable amount of the crosslinking agent, thereby making the low-temperature fixing ability and the offset resistance more excellent. In particular, a toner suitable not only for a high-speed fixing but also a low-speed fixing can be produced. Therefore, this toner is highly suitable for the method for development and the method for forming fixed images of the present invention.

Incidentally, for the purpose of charge control, the charge control agents exemplified above may be properly added to the shell-forming materials of the encapsulated toner of the present invention. Alternatively, the charge control agent may be used in a mixture with a toner. In such a case, since the shell itself controls chargeability, the amount of these charge control agents, if needed, can be minimized.

Although the particle diameter of the encapsulated toner of the present invention is not particularly limitative, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when it exceeds 1 μm, the heat fusibility of the resulting toner becomes undesirably poor.

In the encapsulated toner of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate and zinc silicate, with a preference given to those containing not less than 85% by weight of $SiO_2$. Further, finely powdered silica surface-treated with a silane coupling agent, a titanium coupling agent, silicone oil, and silicone oil having amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate or butyl methacrylate may be added.

Furthermore, for the purposes of reducing the electric resistance on the surface of the toner, a small amount of carbon black may be used. The carbon blacks may be those of conventionally known, including various kinds such as furnace black, channel black, and acetylene black.

The encapsulated toner used in the present invention is thus described, and this encapsulated toner is fixable with a low nip pressure of 0.01 to 4 kg/cm, preferably 0.05 to 3 kg/cm, at an extremely low temperature of 60° to 130° C., excellent in offset resistance and blocking resistance in the encapsulated toner for heat-and-pressure fixing, thereby making it possible to stably form clear visible images free from background for a large number of copying.

EXAMPLES

The present invention is hereinafter described in more detail by means of the following working examples and comparative examples, but the present invention is not limited by these examples.

Production Example 1 for Encapsulated Toner 367.5 g of a propylene oxide adduct of bisphenol A (average adduct molar number: 2.2), 146.4 g of an ethylene oxide adduct of bisphenol A (average adduct molar number: 2.2), 126.0 g of terephthalic acid, 40.2 g of dodecenyl succinic anhydride, and 77.7 g of trimellitic anhydride are placed in a two-liter four-necked glass flask equipped with a thermometer, a stainless steel stirring rod, a reflux condenser and a nitrogen inlet tube, and heated at 220° C. in a mantle heater under a nitrogen gas stream while stirring to react the above components.

The degree of polymerization is monitored from a softening point measured according to ASTM E 28-67, and the reaction is terminated when the softening point reaches 110° C.

The glass transition temperature of the resin obtained above is 65° C. Here, the glass transition temperature is measured by the differential scanning calorimeter ("DSC Model 220," manufactured by Seiko Instruments, Inc.). Also, the softening point and the acid value are, respectively, 110° C. and 18 KOH mg/g. The acid value is measured by the method according to JIS K0070.

Here, the "softening point" used herein refers to the temperature corresponding to one-half of the height (h) of the S-shaped curve showing the relationship between the downward movement of a plunger (flow length) and temperature, when measured by using a flow tester of the "koka" type manufactured by Shimadzu Corporation in which a 1 $cm^3$ sample is extruded through a nozzle having a dice pore size of 1 mm and a length of 1 mm, while heating the sample so as to raise the temperature at a rate of 6° C./min and applying a load of 20 $kg/cm^2$ thereto with the plunger.

0.3 parts by weight of a charge control agent "T-77," (manufactured by Hodogaya Kagaku), 15 parts by weight of the resin obtained above and 3.5 parts by weight of 2,2'-azobisisobutyronitrile are added to a mixture comprising 72.0 parts by weight of styrene, 28.0 parts by weight of 2-ethylhexyl acrylate, 0.9 parts by weight of divinylbenzene and 10.0 parts by weight of carbon black "#44" (manufactured by Mitsubishi Kasei Corporation). The obtained mixture is introduced into an attritor (Model MA-01SC, manufactured by Mitsui Miike Kakoki) and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" (manufactured by Tokushu Kika Kogyo) at 15° C. and a rotational speed of 12000 rpm for 5 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, 440 ml of 1 N hydrochloric acid is added to the dispersing agent. The resulting product is filtered, and the obtained solid is washed with water, dried under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" (manufactured by Nippon Aerozil Ltd.) is added and mixed to obtain the encapsulated toner in the present invention. This toner is referred to as "Toner 1." The glass transition temperature assignable to the resin contained in the core material is 39.8° C., and the softening point of Toner 1 is 128.1° C.

The compressive variation with respect to the load applied to Toner 1 is measured by the following method:

Specifically, the compression variation is measured, when the load is applied to one toner particle, by using a micro compression testing machine MCTM-200 (manufactured by Shimadzu Corporation) at a temperature of 25° C. and humidity of 50%. This testing machine comprises an upper pressurizing element and a lower pressurizing element, wherein the upper pressurizing element is a flat element made of diamond having a diameter of 50 μm, and the lower pressurizing element is a flat plate made of SKS (Special Steel). The load is applied at a speed of 9.1 mgf/sec.

As a result, it is found that the minimum load of 63 mgf is required for 5% compression for one toner particle, and the minimum load of 120 mgf is required for 10% compression.

Production Example 2 for Encapsulated Toner 525.0 g of a propylene oxide adduct of bisphenol A (average adduct molar number: 2.2), 138.6 g of terephthalic acid, and 160.8 g of dodecenyl succinic anhydride, are placed in a two-liter four-necked glass flask equipped with a thermometer, a stainless steel stirring rod, a reflux condenser and a nitrogen inlet tube, and heated at 220° C. in a mantle heater under a nitrogen gas stream while stirring to react the above components.

The degree of polymerization is monitored from a softening point measured according to ASTM E 28-67, and the reaction is terminated when the softening point reaches 110° C.

The glass transition temperature of the resin obtained above is 63° C. Here, the glass transition temperature is measured by the differential scanning calorimeter "DSC Model 220." Also, the softening point and the acid value are measured, they are, respectively, 110° C. and 10 KOH mg/g. The acid value is measured by the method according to JIS K0070.

100 parts by weight of a copolymer obtained by copolymerizing 75 parts by weight of styrene and 25 parts by weight of n-butyl acrylate, the copolymer having a softening point of 75.3° C. and a glass transition temperature of 40.5° C., are premixed together with 6 parts by weight of copper phthalocyanine "Sumikaprint Cyanine Blue GN-O" (manufactured by Sumitomo Chemical Co., Ltd.), 15 parts by weight of the resin obtained above, and 5 parts by weight of polypropylene wax "Viscol 550p" (manufactured by Sanyo Chemical Industries, Ltd.), and melt-kneaded in a twin-screw extruder, cooled and pulverized. 40 parts by weight of this kneaded mixture are blended with 50 parts by weight of styrene, 15 parts by weight of n-butyl acrylate and 2.5 parts by weight of 2,2'-azobisisobutyronitrile to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" at 5° C. and a rotational speed of 12000 rpm for 2 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, 440 ml of 1 N hydrochloric acid is added to the dispersing agent. The resulting product is filtered, and the obtained solid is washed with water, dried under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" is added and mixed to obtain the encapsulated toner in the present invention. This toner is referred to as "Toner 2." The glass transition temperature ascribed to the resin contained in the core material is 33.2° C., and the softening point of Toner 2 is 122.8° C.

The compressive variation with respect to the load applied to Toner 2 is measured in the same manner as in Production Example 1 for Encapsulated Toner. As a result, it is found that the minimum load of 56 mgf is required for 5% compression for one toner particle, and that the minimum load of 110 mgf is required for 10% compression.

Production Example 3 for Encapsulated Toner 15.0 parts by weight of the resin obtained in Production Example 1 for Encapsulated Toner is added to a mixture comprising 65.0 parts by weight of styrene, 35.0 parts by weight of 2-ethylhexyl acrylate, 6.0 parts by weight of 2,2'-azobisisobutyronitrile, 0.8 parts by weight of divinylbenzene, and 1.0 part by weight of a charge control agent "T-77," and this resin is dissolved into the mixture. After completely dissolving the resin mentioned above, 20 parts by weight of styrene-grafted carbon black "GP-E-3" (manufactured by Ryoyu Kogyo) is added thereto, and the resulting mixture is dispersed for 1 hour using a magnetic stirrer to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" at room temperature and a rotational speed of 10000 rpm for 2 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, as the in situ polymerization, the contents are heated to 85° C. and reacted at 85° C. for 10 hours in a nitrogen atmosphere while stirring to give seed particles. The seed particles are cooled to room temperature to give precursor particles.

Next, 122.6 parts by weight of an aqueous emulsion comprising 26.0 parts by weight of styrene, 14.0 parts by weight of 2-ethylhexyl acrylate, 1.6 parts by weight of 2,2'-azobisisobutyronitrile, 0.8 parts by weight of divinylbenzene, 0.2 parts by weight of sodium laurylsulfate, 1.0 part by weight of a charge control agent "T-77," and 80 parts by weight of water is added dropwise to an aqueous suspension containing the above precursor particles, the aqueous emulsion being prepared by a ultrasonic vibrator ("US-150," manufactured by Nippon Seiki Co., Ltd.). Thereafter, as the seed polymerization, the contents are heated to 85° C. and reacted at 85° C. for 10 hours in a nitrogen atmosphere while stirring. After cooling the reaction product, 440 ml of 1 N hydrochloric acid is added to the dispersing agent. The resulting product is filtered, and the obtained solid is washed with water, and air-dried, followed by drying under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" is added and mixed to give the encapsulated toner in the present invention. This toner is referred to as "Toner 3." The glass transition temperature ascribed to the resin contained in the core material is 31.6° C., and the softening point of Toner 3 is 117.0° C.

The compressive variation with respect to the load applied to Toner 3 is measured in the same manner as in Production Example 1 for Encapsulated Toner. As a result, it is found that the minimum load of 22 mgf is required for 5% compression for one toner particle, and that the minimum load of 41 mgf is required for 10% compression.

Production Example 4 for Encapsulated Toner 20 parts by weight of the resin obtained in Production Example 1 for Encapsulated Toner and 3.5 parts by weight of 2,2'-azobisisobutyronitrile are added to a mixture comprising 56.0 parts by weight of styrene, 44.0 parts by weight of 2-ethylhexyl acrylate, 0.9 parts by weight of divinylbenzene and 7.0 parts by weight of carbon black "#44." The obtained mixture is introduced into an attritor "Model MA-01SC," and dispersed at 10° C. for 5 hours to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T.K. HOMO MIXER, Model M" at 15° C. and a rotational speed of 12000 rpm for 5 minutes.

Next, a four-necked glass cap is set on the flask, and a reflux condenser, a thermometer, a nitrogen inlet tube and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, 440 ml of 1 N hydrochloric acid is added to the dispersing agent. The resulting product is filtered, and the obtained solid is washed with water, dried under a reduced pressure of 20 mmHg at 45° C. for 12 hours and classified with an air classifier to give an encapsulated toner with an average particle size of 8 μm whose shell comprises an amorphous polyester.

To 100 parts by weight of this encapsulated toner, 0.4 parts by weight of hydrophobic silica fine powder "Aerozil R-972" is added and mixed to obtain a comparative encapsulated toner. This toner is referred to as "Toner 4." The glass transition temperature ascribed to the resin contained in the core material is 18.5° C., and the softening point of Toner 4 is 107.5° C.

The compressive variation with respect to the load applied to Toner 4 is measured in the same manner as in Production Example 1 for Encapsulated Toner. As a result, it is found that the minimum load of 3.5 mgf is required for 5% compression for one toner particle, and that the minimum load of 6.9 mgf is required for 10% compression.

Example 1

A developer device in a commercially available laser beam printer using an organic photoconductor is replaced with a developer device shown in FIG. 1, and 30 g of the encapsulated toner obtained in Production Example 1 for Encapsulated Toner is placed in a developer vessel, and the above encapsulated toner is also placed in a toner hopper to carry out development.

As a photoconductor 1, an organic photoconductor comprising a charge generation layer containing titanyl phthalocyanine pigment and a charge transport layer containing a hydrazone derivative is used. The photoconductor has a surface voltage of −550 V and rotates at a peripheral speed of 35 mm/sec.

A developer carrying sleeve 4 is a cylinder made of aluminum having an outer diameter of 20 mm and a thickness of 2 mm, and its outer surface is treated so as to have a surface roughness Rz (measured by the method according to JIS B0601) of about 3.0 μm.

A developing blade 5 is semiconductive, which is made of a silicone rubber dispersed with carbon black to give conductivity, the developing blade having a specific resistivity of $10^6$ Ω.cm, a JIS A-type hardness of 60°, a thickness of 2 mm and a nip pressure to the developer carrying sleeve of 1.5 gf/mm.

A gap provided between the developer carrying sleeve 4 and the photoconductor 1 is about 100 μm, and the thickness of the toner layer formed after regulating with the developing blade is about 50 μm.

Continuous printing of 20,000 A4 sheets is carried out at a peripheral speed of the developer carrying sleeve which is twice that of the photoconductor, namely 70 mm/sec, while applying an alternating current voltage of 800 V (P—P) at 500 Hz and a direct current voltage of −500 V with a power source E1.

As a result, high-quality images having a high image concentration (evaluated using a densitometer "MODEL RD914" manufactured by Macbeth Co., printing concentration of the solid portion being 1.3) and having substantially no background (evaluated using a brightness tester, "MODEL 1001DL" manufactured by Nippon Denshoku K.K., the degree of brightness being 0.4) can be obtained without deterioration of the formed images.

Also, no melting of the used toner onto the developing blade or the developer carrying sleeve or no agglomeration of the toner are observed.

Further, a fixing ability is evaluated by using a fixing device comprising a heat roller and a pressure roller, both having diameters of 30 mm, the heat roller being coated with Teflon and the pressure roller being coated with a silicone rubber, both having peripheral speeds of 35 mm/sec, the fixing device having a nip pressure of 0.1 kg/cm, and a nip width of 3 mm. As a result, the lowest fixing temperature is 100° C., and the high-temperature offset generating temperature is 200° C.

The lowest fixing temperature for the toner is the temperature of the paper surface at which the fixing rate of the toner exceeds 70%. This fixing rate of the toner is determined by placing a load of 500 g on a sand-containing rubber eraser having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing rate from this density value and a density value before the eraser treatment using the following equation.

$$\text{Fixing rate (\%)} = \frac{\text{Image density after eraser treatment}}{\text{Image density before eraser treatment}} \times 100$$

Example 2

A developer device in a commercially available laser beam printer using an organic photoconductor is replaced in the same manner as in Example 1 with a developer device shown in FIG. 1, and 30 g of the encapsulated toner obtained in Production Example 1 for Encapsulated Toner is placed in a developer vessel, and the above encapsulated toner is also placed in a toner hopper to carry out development.

As a photoconductor 1, an organic photoconductor comprising a charge generation layer containing titanyl phthalocyanine pigment and a charge transport layer containing a hydrazone derivative is used. The photoconductor has a surface voltage of −550 V and rotates at a peripheral speed of 35 mm/sec.

Continuous printing of 20,000 A4 sheets is carried out is carried under the same conditions as in Example 1 except that a developing blade 5 has a nip pressure of 1.2 gf/mm to the developer carrying sleeve, and that a direct current voltage of −450 V is applied with a power source E2.

As a result, high-quality images having a high image concentration (evaluated using a densitometer "MODEL RD914," the printing concentration of the solid portion being 1.4) and having substantially no background (evaluated using a brightness tester "MODEL 1001DL," the degree of brightness being 0.3) can be obtained without deterioration of the formed images.

Also, no melting of the used toner onto the developing blade or the developer carrying sleeve or no agglomeration of the toner are observed.

Example 3

A developer device in a commercially available laser beam printer using an organic photoconductor is replaced with a developer device shown in FIG. 2, and 30 g of the encapsulated toner obtained in Production Example 2 for Encapsulated Toner is placed in a developer vessel, and the above encapsulated toner is also placed in a toner hopper to carry out development.

As a photoconductor 1, an organic photoconductor comprising a charge generation layer containing titanyl phthalocyanine pigment and a charge transport layer containing a hydrazone derivative is used. The photoconductor rotates at a peripheral speed of 35 mm/sec and has a surface voltage of −550 V.

A developer carrying sleeve 4 is a cylinder made of aluminum having an outer diameter of 20 mm and a thickness of 2 mm, and its outer surface is treated so as to have a surface roughness Rz of about 3.0 μm.

A developing blade 5 is semiconductive, which is made of a silicone rubber dispersed with carbon black to give conductivity, the developing blade having a specific resistivity of $10^6$ Ω.cm, a JIS A-type hardness of 60°, a thickness of 2 mm and a nip of 1.0 gf/mm pressure to the developer carrying sleeve.

A gap provided between the developer carrying sleeve 4 and the photoconductor 1 is about 100 μm, and the thickness of the toner layer formed after regulating with the developing blade is about 50 μm.

A conductive fibrous brush 7 is made of resin filaments prepared by dispersing carbon black in rayon to give conductivity. Each filament has a thickness of is 400 denier/40 filaments, and the density of the filaments is $3.5\times10^4$ filaments/in$^2$, and the specific resistivity is $10^4$ Ω.cm. The conductive fibrous brush 7 comprises a stainless shaft and filaments adhered to the shaft by conductive adhesives.

Continuous printing of 20,000 A4 sheets is carried out at a peripheral speed of the developer carrying sleeve and a peripheral speed of the conductive fibrous brush which are, respectively, twice that and 2.5 times that of the photoconductor, namely 70 mm/sec and 87.5 mm/sec, while applying a direct current voltage of −500 V to the developer carrying sleeve with a power source E1, a direct current voltage of −450 V to the developing blade with a power source E2, and a direct current voltage of −900 V to the developing blade with a power source E3.

As a result, high-quality images having a high image concentration (evaluated using a densitometer "MODEL RD914," printing concentration of the solid portion being 1.4) and having substantially no background (evaluated using a brightness tester, "MODEL 1001DL," the degree of brightness being 0.2) can be obtained without deterioration of the formed images.

Also, no melting of the used toner onto the developing blade or the developer carrying sleeve or no agglomeration of the toner are observed.

Further, a fixing ability is evaluated in the same manner as in Example 1. As a result, the lowest fixing temperature is 95° C., and the hot offset generating temperature is 220° C.

Example 4

A developer device in a commercially available laser beam printer using an organic photoconductor is replaced with a developer device shown in FIG. 3, and 30 g of the encapsulated toner obtained in Production Example 1 for Encapsulated Toner is placed in a developer vessel, and the above encapsulated toner is also placed in a toner hopper to carry out development.

As a photoconductor 1, an organic photoconductor comprising a charge generation layer containing titanyl phthalocyanine pigment and a charge transport layer containing a hydrazone derivative is used. The photoconductor has a surface voltage of −550 V and rotates at a peripheral speed of 30 mm/sec.

A developer carrying sleeve 4 is a cylindrical thin layered member made of nickel having an outer diameter of 22 mm and a thickness of 40 μm, and its outer surface is treated so as to have a surface roughness Rz of about 3.0 μm.

A developing blade 5 is made of SUS stainless steel, having a thickness of 0.2 mm, and it has a nip pressure of 1.2 gf/mm to the developer carrying sleeve.

A contacting width formed between the developer carrying sleeve 4 and the photoconductor 1 is about 2 mm, and the thickness of the toner layer formed after regulating with the developing blade is about 20 μm.

Continuous printing of 20,000 A4 sheets is carried out at a peripheral speed of the developer carrying sleeve which is twice that of the photoconductor, namely 60 mm/sec, while applying an alternating current voltage of 600 V (P—P) at 500 Hz and a direct current voltage of −500 V with a power source E1.

As a result, high-quality images having a high image concentration (evaluated using a densitometer "MODEL RD914," printing concentration of the solid portion being 1.4) and having substantially no background (evaluated using a brightness tester, "MODEL 1001DL," the degree of brightness being 0.2) can be obtained without deterioration of the formed images.

Also, no melting of the used toner onto the developing blade or the developer carrying sleeve or no agglomeration of the toner are observed.

Example 5

A developer device in a commercially available laser beam printer using an organic photoconductor is replaced in the same manner as in Example 1 with a developer device shown in FIG. 1, and 30 g of the encapsulated toner obtained in Production Example 3 for Encapsulated Toner is placed in a developer vessel, and the above encapsulated toner is also placed in a toner hopper to carry out development.

As a photoconductor 1, an organic photoconductor comprising a charge generation layer containing titanyl phthalocyanine pigment and a charge transport layer containing a hydrazone derivative is used. The photoconductor has a surface voltage of −550 V and rotates at a peripheral speed of 35 mm/sec.

Continuous printing of 20,000 A4 sheets is carried out is carried under the same conditions as in Example 1 except that a developing blade 5 has a nip pressure of 0.8 gf/mm to the developer carrying sleeve, and that a direct current voltage of −450 V is applied with a power source E2.

As a result, high-quality images having a high image concentration (evaluated using a densitometer "MODEL RD914," the printing concentration of the solid portion being 1.4) and having substantially no background (evaluated using a brightness tester "MODEL 1001DL," the degree of brightness being 0.3) can be obtained without deterioration of the formed images.

Also, no melting of the used toner onto the developing blade or the developer carrying sleeve or no agglomeration of the toner are observed.

Example 6

A developer device in a commercially available laser beam printer using an organic photoconductor is replaced with a developer device shown in FIG. 2, and 30 g of the encapsulated toner obtained in Production Example 3 for Encapsulated Toner is placed in a developer vessel, and the above encapsulated toner is also placed in a toner hopper to carry out development.

As a photoconductor 1, an organic photoconductor comprising a charge generation layer containing titanyl phthalocyanine pigment and a charge transport layer containing a hydrazone derivative is used. The photoconductor rotates at a peripheral speed of 35 mm/sec and has a surface voltage of −550 V.

A developer carrying sleeve 4 is a cylinder made of aluminum having an outer diameter of 20 mm and a thickness of 2 mm, and its outer surface is treated so as to have a surface roughness Rz of about 3.0 μm.

A developing blade 5 is semiconductive, which is made of a silicone rubber dispersed with carbon black to give conductivity, the developing blade having a specific resistivity of $10^6$ Ω.cm, a JIS A-type hardness of 60°, a thickness of 2 mm and a nip pressure of 0.6 gf/mm to the developer carrying sleeve.

A gap provided between the developer carrying sleeve 4 and the photoconductor 1 is about 100 μm, and the thickness of the toner layer formed after regulating with the developing blade is about 50 μm.

A conductive fibrous brush 7 is made of resin filaments prepared by dispersing carbon black in rayon to give conductivity. Each filament has a thickness of is 400 denier/40 filaments, and the density of the filaments is $3.5\times10^4$ filaments/in$^2$, and the specific resistivity is $10^4$ Ω.cm. The conductive fibrous brush 7 comprises a stainless shaft and filaments adhered to the shaft by conductive adhesives.

Continuous printing of 20,000 A4 sheets is carried out at a peripheral speed of the developer carrying sleeve and a peripheral speed of the conductive fibrous brush which are, respectively, twice that and 2.5 times that of the photoconductor, namely 70 mm/sec and 87.5 mm/sec, while applying a direct current voltage of −500 V to the developer carrying sleeve with a power source E1, a direct current voltage of −450 V to the developing blade with a power source E2, and a direct current voltage of −900 V to the developing blade with a power source E3.

As a result, high-quality images having a high image concentration (evaluated using a densitometer "MODEL RD914," printing concentration of the solid portion being 1.4) and having substantially no background (evaluated using a brightness tester, "MODEL 1001DL," the degree of brightness being 0.2) can be obtained without deterioration of the formed images.

Also, no melting of the used toner onto the developing blade or the developer carrying sleeve or no agglomeration of the toner are observed.

Further, a fixing ability is evaluated in the same manner as in Example 1. As a result, the lowest fixing temperature is 85° C., and the hot offset generating temperature is 220° C.

Comparative Example 1

The same printing test as in Example 1 is carried out except that Toner 1 is replaced with Toner 4.

As a result, after copying A4 2000 sheets, the melting of the toners onto the developer carrying sleeve takes place.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing method using a developer device comprising a developer carrying sleeve arranged in contact with or near an electrostatic latent image forming member and a developer blade arranged opposite to the developer carrying sleeve, the method comprising the steps of:

forming a layer of nonmagnetic one-component toner particles on said developer carrying sleeve;

regulating the thickness of said layer to form a uniform layer of said toner particles on said developer carrying sleeve with said developer blade at a nip pressure between said developer carrying sleeve and said developer blade of 0.1 to 3.0 gram-force/millimeter;

rotating said electrostatic latent image forming member and said developer carrying sleeve; and applying the toner particles on said developer carrying sleeve onto an electrostatic latent image formed on said electrostatic latent image forming member to visualize the electrostatic latent image, wherein the toner particles are encapsulated toner particles comprising a heat-fusible core material comprising at least a thermoplastic resin and a coloring agent, and a shell formed thereon so as to cover the surface of the core material, the glass transition temperature ascribed to the thermoplastic resin of the core material being 10° C. to 50° C., and wherein said toner particles have the following properties: (a) the minimum load required for 5% compression of the particle size is 5 to 80 milligram-force; and (b) the minimum load required for 10% compression of the particle size is 10 to 160 milligram-force, wherein said properties of one toner particle are measured by using a micro compression testing machine comprising a flat upper pressurizing element made of diamond having a diameter of 50 μm and a flat lower pressurizing element made of SKS (Special Steel) at a temperature of 25° C. and a humidity of 50%, and the load is applied at a speed of 9.1 milligram-force/second.

2. The method according to claim 1, wherein a direct current voltage is applied between the electrostatic latent image forming member and the developer carrying sleeve.

3. The method according to claim 2, wherein said direct current voltage applied is ±50 to ±2000 V.

4. The method according to claim 2, wherein an alternating voltage is further applied between the electrostatic latent image forming member and the developer carrying sleeve.

5. The method according to claim 4, wherein said alternating voltage applied is an alternating current of 100 to 2000 V at 100 to 3000 Hz.

6. The method according to claim 1, wherein said electrostatic latent image forming member is a photoconductor.

7. The method according to claim 1, wherein said encapsulated toner particles have a shell comprising an amorphous polyester.

8. A method for forming fixed images comprising the steps of:

forming an electrostatic latent image on an electrostatic latent image forming member;

applying a toner to said electrostatic latent image, thereby developing the electrostatic latent image to form a visible image; and transferring and fixing the formed visible image to a recording medium, wherein the developing process is carried out by the method according to claim 1.

9. The method according to claim 1, wherein said encapsulated toner particles have a shell thickness of 0.01 to 1 μm.

* * * * *